US005605323A

United States Patent [19]

Wirth et al.

[11] Patent Number: 5,605,323

[45] Date of Patent: Feb. 25, 1997

[54] IMAGING APPARATUS WITH SHEET MEDIA TRAY HAVING PARTIAL SIDES

[75] Inventors: Henry G. Wirth; Mark A. Bobb, both of Rochester, N.Y.

[73] Assignee: Eastman Kodak Company, Rochester, N.Y.

[21] Appl. No.: 407,836

[22] Filed: Mar. 21, 1995

[51] Int. Cl.[6] ..... B65H 1/04

[52] U.S. Cl. ..... 271/145; 271/164

[58] Field of Search ..... 271/145, 162, 271/164, 171, 241; 206/215, 449, 557

[56] References Cited

U.S. PATENT DOCUMENTS

| | | | |
|---|---|---|---|
| 3,847,387 | 11/1974 | Sick | 271/171 |
| 3,936,044 | 2/1976 | Kramer | 271/171 |
| 4,174,103 | 11/1979 | Back et al. | 271/171 |
| 5,013,025 | 5/1991 | Arai et al. | 271/145 |
| 5,076,562 | 12/1991 | Sai et al. | 271/241 |
| 5,121,169 | 6/1992 | Kawabata | 271/171 |
| 5,172,903 | 12/1992 | Haneda et al. | 271/171 |
| 5,251,889 | 10/1993 | Spencer et al. | 271/171 |
| 5,328,167 | 7/1994 | Frank | 271/241 |

FOREIGN PATENT DOCUMENTS

| | | | |
|---|---|---|---|
| 242326 | 9/1989 | Japan | 271/241 |
| 3088630 | 4/1991 | Japan | 271/145 |
| 2089771 | 6/1982 | United Kingdom | 271/171 |

*Primary Examiner*—David A. Bucci
*Assistant Examiner*—Douglas Hess
*Attorney, Agent, or Firm*—Milton S. Sales

[57] ABSTRACT

A tray for holding a stack of sheets of imaging media to be fed to an imaging apparatus in a feed direction includes a base having a generally planar surface for receiving a stack of imaging media sheets. A plurality of sides extend generally perpendicular from the surface of the base on one side of the base to partially surround the received stack of sheets on the one side of the base. At least one of the sides terminates short of the end of the received stack of sheets in the feed direction such as to provide the received stack of sheets with an exposed lateral edge to be contacted by an alignment mechanism of the imaging apparatus. The plurality of sides include two parallel sides on opposed sides of the received stack of sheets, at least one of the sides being one of the two parallel sides. A third side is normal to the two parallel sides, and is connected to the two parallel sides. A fourth side is normal to the two parallel sides and is separated from the third side and the two parallel sides.

5 Claims, 4 Drawing Sheets

IMAGING APPARATUS WITH SHEET MEDIA TRAY HAVING PARTIAL SIDES

BACKGROUND OF THE INVENTION

1. Technical Field

This invention relates generally to imaging apparatus such as printers and/or copiers, and more particularly to sheet media trays for such apparatus.

2. Background Art

Imaging apparatus such as printers and/or copiers typically use complex and expensive trays to hold sheets of image receiver media so that the sheets are accurately positioned for receiving images. The complexity of these trays often requires a different tray for each size of sheet used in the imaging apparatus. Thus, many sizes of trays must be purchased and stored when not in use. Other types of trays can be adjusted to receive different size sheets, but the adjustment process can be complicated and time consuming.

Typically, sheet media trays include complex mechanisms for biasing sheets upwardly, and have corner tabs to insure that only a single sheet is fed from the tray at a time. The tray itself is adapted to accurately locate the sheets both in a side-to-side direction and in a top-to-bottom direction, but in order to achieve the necessary alignment of the sheets to the sheet transport path internal to the imaging apparatus, manufacturing tolerances must be accurately maintained both in relation to the position of the tray to the internal sheet transport mechanisms of the imaging apparatus and in relation to the position of the sheets in the tray.

DISCLOSURE OF THE INVENTION

It is an object of the present invention to provide a sheet media tray for imaging apparatus that overcomes the cost, complexity, and storage issues involved with such trays known in the prior art.

It is another object of the present invention to provide a sheet media tray for imaging apparatus that accurately aligns the sheets with the sheet transport mechanism of the imaging apparatus by providing partial sides, allowing rails in the imaging apparatus to align the sheets in the tray.

It is still another object of the present invention to provide a sheet media tray for imaging apparatus that can be used with different size sheets without a complicated and time consuming adjustment process, eliminating the need for different and dedicated trays for each size receiver sheet.

According to the present invention, a tray for holding a stack of sheets of imaging media to be fed to an imaging apparatus in a feed direction includes a base having a generally planar surface for receiving a stack of imaging media sheets. A plurality of sides extend generally perpendicular from the surface of the base on one side of the base to partially surround the received stack of sheets on the one side of the base. At least one of the sides terminates short of the end of the received stack of sheets in the feed direction such as to provide the received stack of sheets with an exposed lateral edge to be contacted by an alignment mechanism of the imaging apparatus.

In a preferred embodiment of the present invention, the plurality of sides include two parallel sides on opposed sides of the received stack of sheets, at least one of said sides being one of the two parallel sides. A third side is normal to the two parallel sides, and is connected to said two parallel sides. A fourth side is normal to the two parallel sides and is separated from the third side and said two parallel sides.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
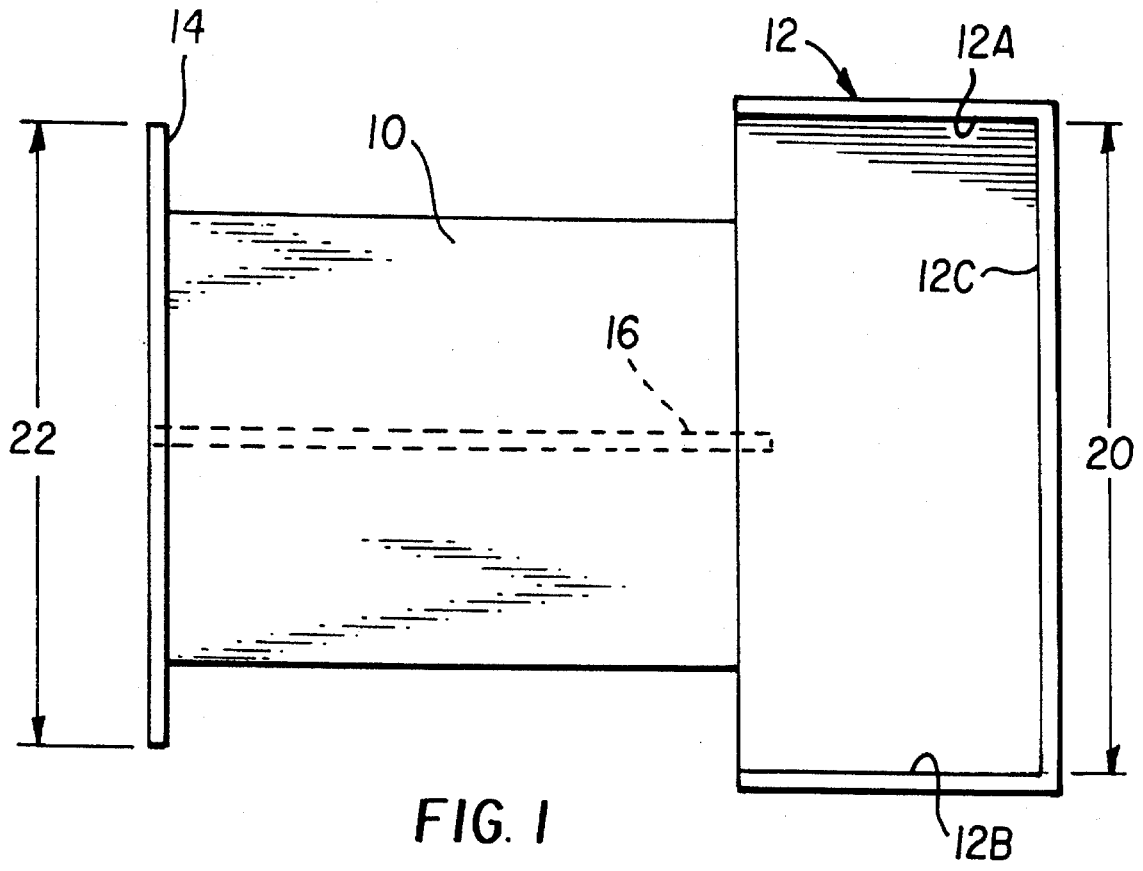
FIG. 1 is a top plan view of a sheet media tray according to a preferred embodiment of the present invention.
Figure 2:
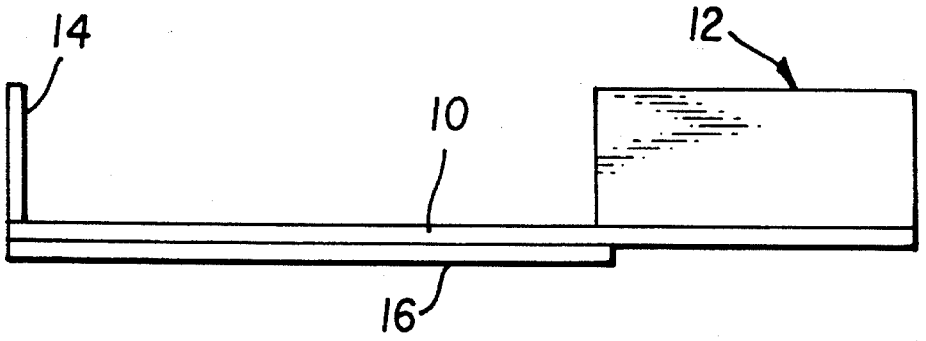
FIG. 2 is a side elevational view of the sheet media tray of FIG. 1.

Referring to FIGS. 1 and 2, a sheet media tray according to the preferred embodiment of the present invention includes a base 10, two partial sides 12A and 12B, a first end 12C, and a second end 14. Partial sides 12A and 12B and first end 12C form three of the tray's sides and, as a unit, are referred to collectively wall unit 12.

Figure 3:
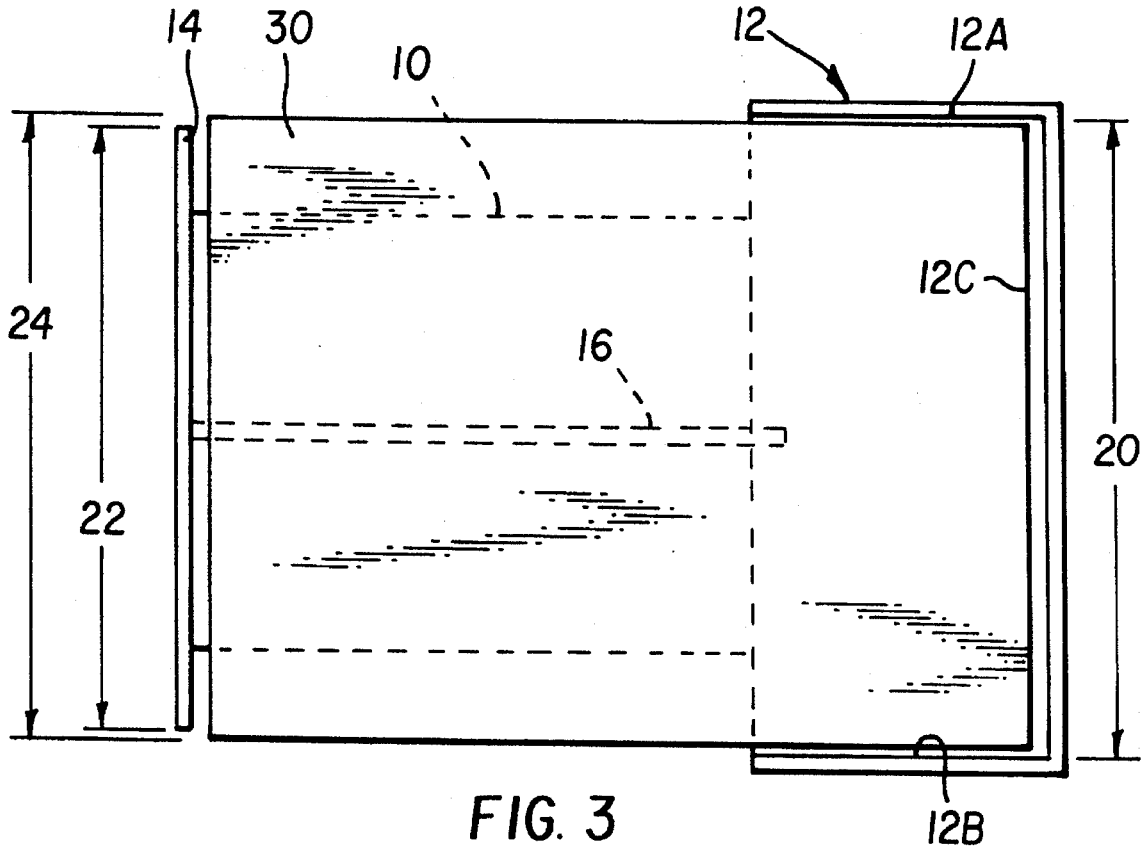
FIG. 3 is a top plan view of the sheet media tray of FIG. 1 shown loaded with sheets.
Figure 4:
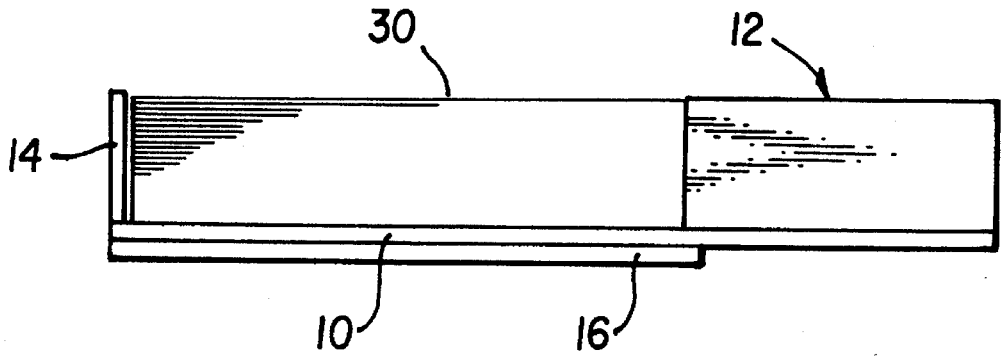
FIG. 4 is a side elevational view of the sheet media tray of FIG. 1 shown loaded with sheets.

Partial sides 12A and 12B and first end 12C may be attached to each other as shown in FIG. 1, or they may be independent of each other to allow for adjustment for differing sheet widths. Partial sides 12A and 12B are separated by a distance 20, which is selected to accommodate the width 24 of sheets 30 placed in the tray, as shown in FIGS. 3 and 4.

Partial sides 12A and 12B and first end 12C are separated from second end 14, which forms the fourth side of the tray. Second end 14 has a length 22 which is less than or equal to the width 24 of the sheets to be used in the tray. Generally, length 22 will be less than width 24 to allow easy alignment of sheets 30 to the internal sheet transport mechanism of the imaging apparatus, as will be explained below.

A linear guide 16 on the bottom of tray base 10 aids alignment of the tray to the imaging apparatus' internal sheet transport mechanism while the tray is being inserted into the imaging apparatus.

Figure 5:
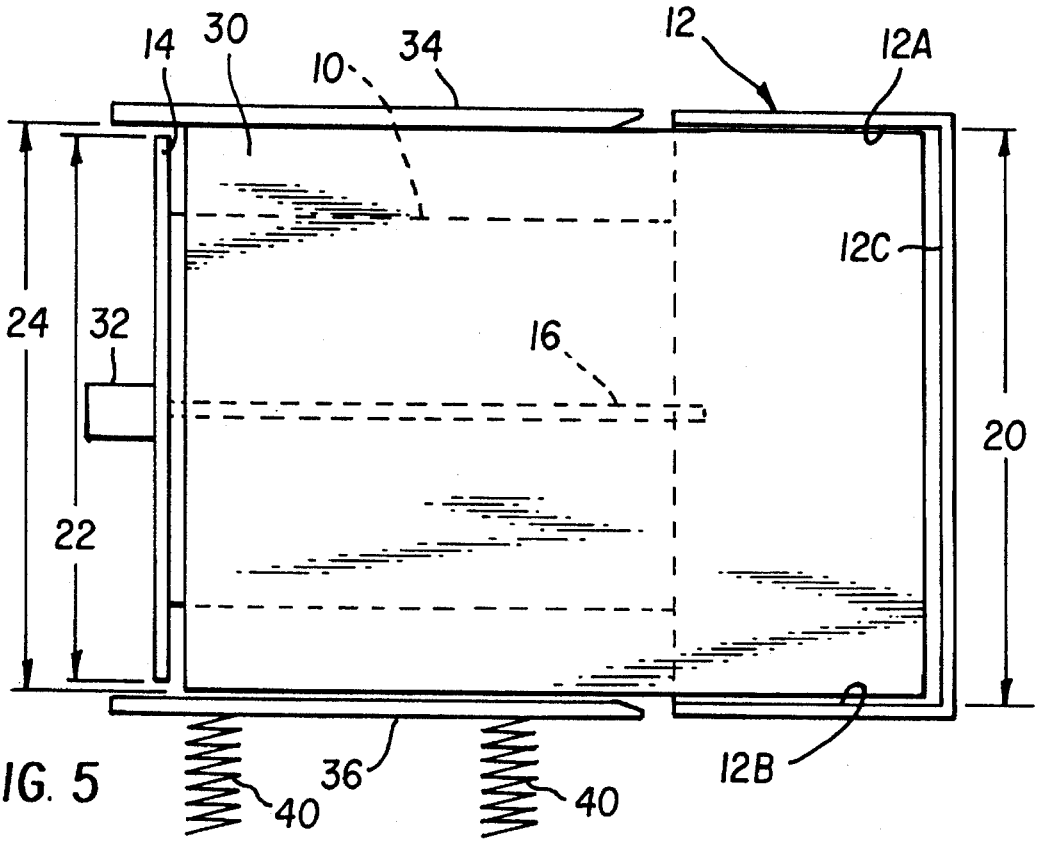
FIG. 5 is a top plan view of a sheet media tray according to a second preferred embodiment of the present invention.

Referring to FIG. 5, a stack of media sheets 30 have been received between second end 14 and wall unit 12. The tray has been shown inserted into imaging apparatus by alignment of guide 16 to a channel or similar guide structure, not shown, in the imaging apparatus. As the tray first enters the imaging apparatus, second end 14 of the tray passes between a pair of alignment rails 34 and 36 that are part of the imaging apparatus's internal sheet transport mechanism. Alignment rails 34 and 36 may be fixed or adjustable to accommodate various media sheet widths. In the illustrated example, second alignment rail 36 has an adjustment mechanism 40 such as a spring-loading device.

As the tray proceeds into the imaging apparatus, sheets 30 engage alignment rails 34 and 36. The location of, and spacing between, the alignment rails is such that the sheets engage at least one rail. A taper on the end of alignment rails 34 and 36 may be provided as illustrated to insure that the corners of the media sheets are not damaged by the alignment rails. As the tray proceeds further into the imaging apparatus, rails 34 and 36 align sheets 30 to the imaging apparatus' internal sheet transport mechanism. An abutment member 32 stops further advancement of the tray when it has moved the desired distance into the imaging apparatus. Rail alignment mechanism 40 moves alignment rail 36 toward sheets 30 to insure that both alignment rails 34 and 36 are sufficiently close to the sheets to provide alignment.

Figure 6:
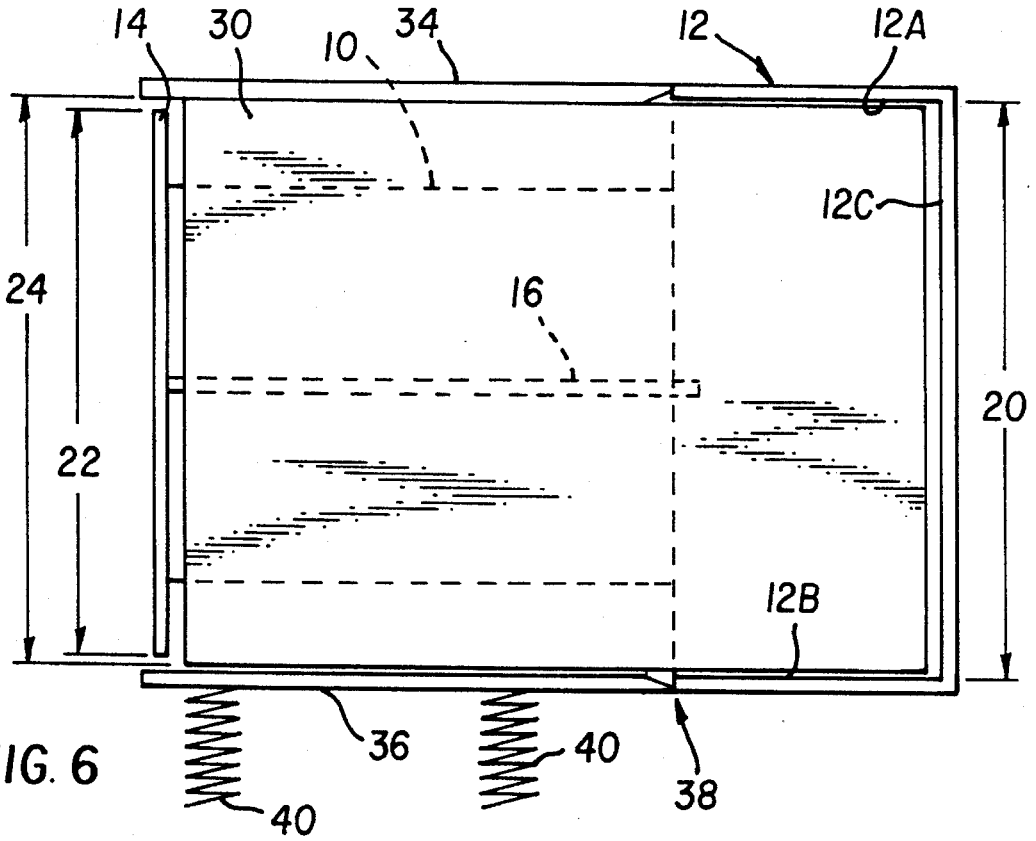
FIG. 6 is a top plan view of a sheet media tray according to a third preferred embodiment of the present invention.

An alternative embodiment of the present invention is illustrated in FIG. 6, wherein abutment member 32 of FIG. 5 is not needed. In FIG. 6, the tray proceeds in the imaging apparatus until one or both of alignment rails 34 and 36 engage a respective side 12A and 12 B of the tray. After such engagement, further movement of the tray into the imaging apparatus is inhibited.

Figure 7:
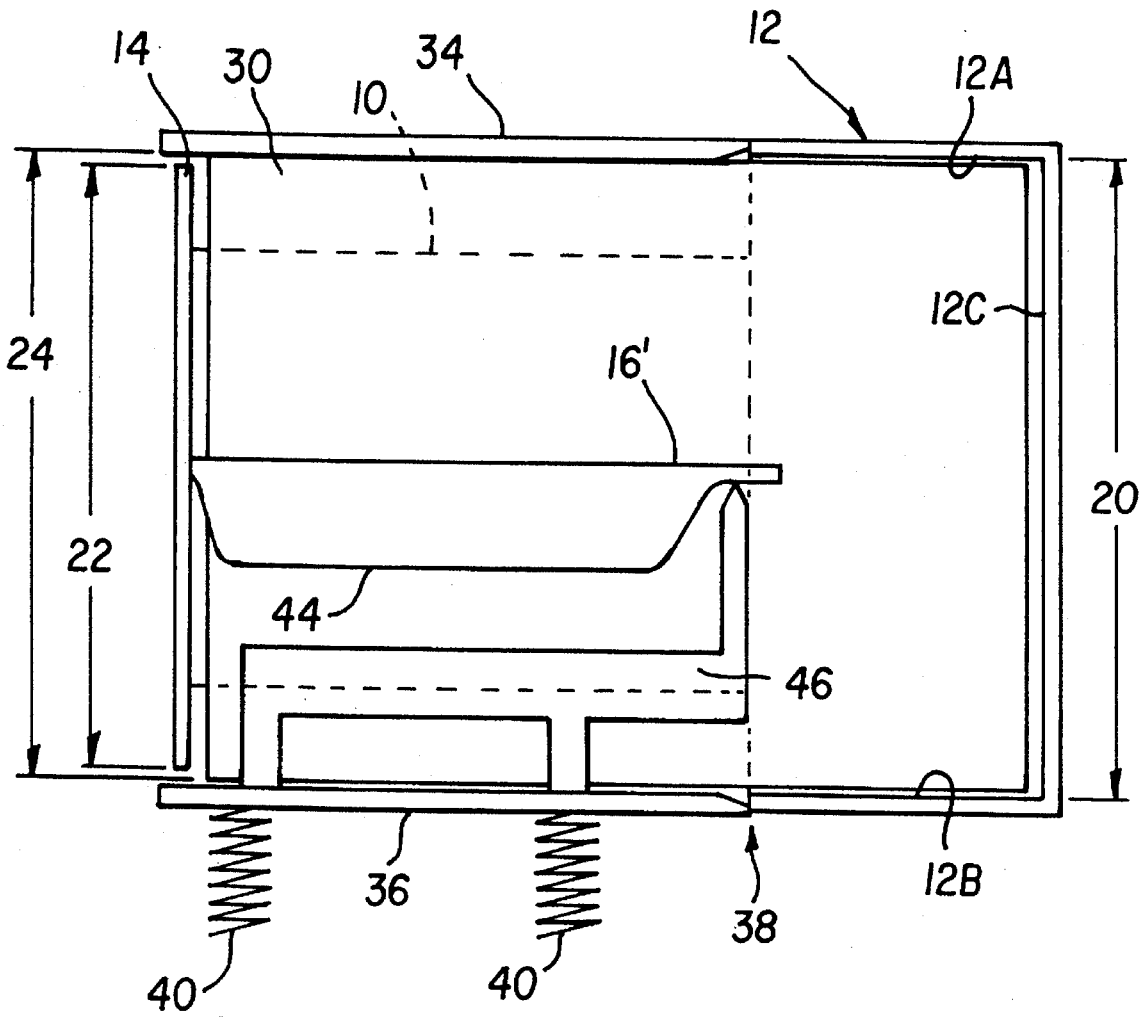
FIG. 7 is a top plan view of a sheet media tray according to a fourth preferred embodiment of the present invention.

Another alternative embodiment of the present invention is illustrated in FIG. 7. Guide 16' includes a cam member 44. Alignment rail 36 if the imaging apparatus includes a cam follower 46. When the tray is inserted into the imaging apparatus, cam follower 46 abuts the leading surface of cam member 44, causing alignment rail 36 to be moved away from receiver sheets 30 against the force of the springs of alignment mechanism 40 as the tray enters the imaging apparatus. Once the tray has been substantially inserted into the imaging apparatus, cam follower 46 rides down the trailing surface of cam member 44, allowing the alignment mechanism springs to press alignment rail 36 against sheets 30. When the tray is removed from the imaging apparatus, the steps are reversed.

It can be seen that an imaging apparatus with sheet media tray having partial sides according to the present invention as described herein provides a much less complex tray design which reduces costs significantly. The mechanism is simpler because media sheet alignment is controlled by internal imaging apparatus structure rather than with a tray feature that must itself be aligned to the imaging apparatus. Thus simpler tolerances and fewer parts can be used.

The invention has been described in detail with particular reference to preferred embodiments thereof, but it will be understood that variations and modifications can be effected within the spirit and scope of the invention.

What is claimed is:

1. A tray for holding a stack of sheets of imaging media to be fed to an imaging apparatus in a feed direction, said tray comprising:

a base having a generally planar surface for receiving a stack of imaging media sheets; and a plurality of sides extending generally perpendicular from the surface of the base on one side of the base to partially surround the received stack of sheets on the one side of the base, at least one of said sides terminating short of the end of the received stack of sheets in the feed direction such as to provide the received stack of sheets with an exposed lateral edge relative to the feed direction, said exposed lateral edge to be contacted by an alignment mechanism of the imaging apparatus, wherein said plurality of sides include two parallel sides on opposed sides of the received stack of sheets, said at least one of said sides being one of the two parallel sides, a third side normal to said two parallel sides and to said base, and a fourth side normal to said two parallel sides and separated from the third side and said two parallel sides, whereby the length of the fourth side is less than or equal to the width of the stack of sheets.

2. A tray as set forth in claim 1 wherein said third side is connected to said two parallel sides.

3. An imaging apparatus and tray for holding a stack of sheets of imaging media to be fed to the imaging apparatus in a feed direction, said apparatus and tray comprising:

a base on the tray having a generally planar surface for receiving a stack of imaging media sheets;

a plurality of sides extending generally perpendicular from the surface of the base on one side of the base to partially surround the received stack of sheets on the one side of the base, at least one of said sides terminating short of the end of the received stack of sheets in the feed direction such as to provide the received stack of sheets with an exposed lateral edge relative to the feed direction, and another of said sides being normal to said one side and to said base; and an alignment mechanism of the imaging apparatus positioned to contact and align the exposed lateral edge of the received stack of sheets when a tray is inserted into the imaging apparatus to provide lateral alignment of the sheets relative to the imaging apparatus.

4. An imaging apparatus and tray for holding a stack of sheets of imaging media to be fed to the imaging apparatus in a feed direction, said apparatus and tray comprising:

a base on the tray having a generally planar surface for receiving a stack of imaging media sheets;

a plurality of sides extending generally perpendicular from the surface of the base on one side of the base to partially surround the received stack of sheets on the one side of the base, at least one of said sides terminating short of the end of the received stack of sheets in the feed direction such as to provide the received stack of sheets with an exposed lateral edge relative to the feed direction; and an alignment mechanism of the imaging apparatus positioned to contact and align the exposed lateral edge of the received stack of sheets when a tray is inserted into the imaging apparatus to provide lateral alignment of the sheets relative to the imaging apparatus, wherein said alignment mechanism abuts the sides of the tray when a tray is inserted into the imaging apparatus to inhibit further insertion of the tray into the imaging apparatus.

5. An imaging apparatus and tray for holding a stack of sheets of imaging media to be fed to the imaging apparatus in a feed direction, said apparatus and tray comprising:

a base on the tray having a generally planar surface for receiving a stack of imaging media sheets;

a plurality of sides extending generally perpendicular from the surface of the base on one side of the base to partially surround the received stack of sheets on the one side of the base, at least one of said sides terminating short of the end of the received stack of sheets in the feed direction such as to provide the received stack of sheets with an exposed lateral edge relative to the feed direction; and an alignment mechanism of the imaging apparatus positioned to contact and align the exposed lateral edge of the received stack of sheets when a tray is inserted into the imaging apparatus to provide lateral alignment of the sheets relative to the imaging apparatus, wherein said tray includes means for moving the alignment mechanism out of contact with the exposed lateral edge of the received stack of sheets as the tray is inserted into the imaging apparatus.

* * * * *